US005765767A

United States Patent [19]

Iwata et al.

[11] Patent Number: 5,765,767

[45] Date of Patent: Jun. 16, 1998

[54] APPARATUS FOR GRINDING AND UNIFORMIZING GRAINS AND SCREEN WITH ANNULAR WORKING SPACE FOR USE IN THE APPARATUS

[75] Inventors: Akira Iwata; Masao Nakano; Akihiro Furuichi, all of Kobe, Japan

[73] Assignee: Fukae Kogyo Kabushiki Kaisha, Hyogo, Japan

[21] Appl. No.: 667,745

[22] Filed: Jun. 21, 1996

[30] Foreign Application Priority Data

Aug. 11, 1995 [JP] Japan ..... 7-205426
Mar. 22, 1996 [JP] Japan ..... 8-065629

[51] Int. Cl.[6] ..... B02C 23/16

[52] U.S. Cl. ..... 241/74; 241/286

[58] Field of Search ..... 241/286, 74

[56] References Cited

U.S. PATENT DOCUMENTS 1,515,113 11/1924 Holmquist et al. .
2,886,254 5/1959 Rohlinger et al. ..... 241/74
4,605,173 8/1986 Edmonds .
5,282,579 2/1994 Poser et al. ..... 241/74
5,544,821 8/1996 Gupta et al. ..... 241/74

FOREIGN PATENT DOCUMENTS 54-12183 1/1979 Japan .
2-39566 10/1990 Japan .
4-44176 10/1992 Japan .
6-98289 12/1994 Japan .

*Primary Examiner*—Mark Rosenbaum
*Attorney, Agent, or Firm*—McDermott, Will & Emery

[57] ABSTRACT

A double screen (42) including a cylindrical screen (18) and a conical screen (23) is attached to an upper casing (3) into which a revolution shaft (11) is inserted and is provided with a supply opening (2). A rotary blade 12 is arranged within an annular space (15) having a nearly V-shaped section between the cylindrical screen (18) and the conical screen (23) so as to rotate keeping a desired gap relative to the respective screen surfaces. Since the annular space (15) having the nearly V-shaped section is spaced apart from the revolution shaft (11), the rotary blade (12) rotates at a high circumferential speed even in the bottom portion of the annular space (15).

18 Claims, 18 Drawing Sheets

APPARATUS FOR GRINDING AND UNIFORMIZING GRAINS AND SCREEN WITH ANNULAR WORKING SPACE FOR USE IN THE APPARATUS

BACKGROUND OF THE INVENTION

1. Field of the Invention

The present invention relates to an apparatus for grinding and uniformizing grains which grinds the grains by pushing them against a screen having uniformizing openings by means of a rotary blade and uniformizes the grains to a certain grain diameter by making them pass through the uniformizing openings.

2. Description of Prior Art

Such an apparatus is basically used for further uniformizing grains manufactured by a granulation machine. For example, the apparatus is used for manufacturing granular medicines in the medicinal business quarters and also for a uniformizing process of foodstuf in the food business quarters. Sizes of the grains to be produced by this grinding and uniformizing apparatus depend mainly upon sizes of uniformizing openings formed in a screen. Generally, the apparatus of this type is capable of processing the grains having diameters of about 0.2 mm through about 6~7 mm. A screen diameter ranges from about 100 mm through about 1000 mm and a scale enlargement is intended mainly for the increasing of processing capacity per one machine.

As a conventional structure of this grinding and uniformizing apparatus there have been known the one employing a cylindrical screen as disclosed in the Japanese Utility Model Publication No. 4-44176 and the ones employing a conical screen as disclosed in the Japanese Patent Publication No. 6-98289 and the Japanese Utility Model Publication No. 2-39566. Further, the apparatus disclosed in the Japanese Utility Model Laid Open Publication No. 54-12183 employs the cylindrical screen, the conical screen or a combination thereof. In all of the above-mentioned conventional structures, fundamentally the single cylindrical screen or the single conical screen is used as the grinding and uniformizing screen, and even the combination of the cylindrical screen and the conical screen is constructed by merely arranging those screens in tandem in their axial direction.

FIG. 15 is a vertical sectional view showing a schematic construction of the grinding and uniformizing apparatus disclosed in the Japanese Utility Model Publication No. 2-39566. In this grinding and uniformizing apparatus, an inverted conical screen 91 having uniformizing openings formed in its circumferential surface is mounted to a lower side of a cylindrical upper casing 90 and an inverted conical casing 92 is attached to the lower side thereof so as to cover the inverted conical screen 91 to form a delivery passage 93 for uniformized granular product between the inverted conical casing 92 and the inverted conical screen 91. A rotary blade 94 to be driven by a motor 95 is installed into the inverted conical screen 91, and an inclination angle of the rotary blade 94 is set equally to an inclination angle of the inverted conical screen 91.

In the conventional apparatus as shown in FIG. 15, however, there appears the following problems.

(1) Since a screening area is small relatively when considering an outer dimension D of the screen, it is impossible to increase its processing capacity.

(2) Since a circumferential speed of the rotary blade 94 is small at a bottom area of the inverted conical screen 91, a force for expelling granular material to be uniformized (simply referred to as granular material hereinafter) through the uniformizing openings at the bottom area becomes small. Therefore, the granular material dropped to the bottom area of the inverted conical screen 91 due to the gravity effect are hardly expelled through the uniformizing openings and resultantly are apt to stagnate there.

(3) Since the rotary blade 94 is formed in the inverted conical configuration, there exists a large difference between the expelling force acting to the uniformizing openings at the upper area of the inverted conical screen 91 and the expelling force acting to the uniformizing openings at the bottom area thereof. Therefore, in the fundamental construction, the grinding and uniformizing action is apt to become uneven at the vertical locations of the screen, so that the uniformized granular product tends to become uneven.

SUMMARY OF THE INVENTION

The present invention is directed to solving the above-mentioned problems. It is an object of the present invention to provide an apparatus for grinding and uniformizing grains which is capable of increasing a screening area relative to a screen external dimension to improve its processing capacity and to provide a screen with an annular working space for use in that apparatus.

It is another object of the present invention to provide an apparatus for grinding and uniformizing grains which is capable of solving a problem that a grinding and uniformizing action is apt to becomes uneven partially like in the conventional screen.

Other objects and advantages of the present invention will become apparent when considered with the following detailed description.

For accomplishing the above-mentioned respective objects, an apparatus for grinding and uniformizing grains is constructed as follows.

For example, with reference to FIG. 1, an apparatus for grinding and uniformizing grains comprises a casing 3 provided with a supply opening for granular material and opened downward, an outside screen 7 attached to a lower position of the casing 3, having its upper portion opened toward the casing 3, having a large number of uniformizing openings 13 formed in its outer circumferential surface and being rotationally symmetrical with respect to a revolution shaft 11, a symmetrical body 14 of revolution disposed inside of the outside screen 7 coaxially with the outside screen 7 with its diameter increasing from its upper portion to its lower portion, and a rotary blade 12 driven about the revolution shaft 11 within an annular space 15 formed between the outside screen 7 and the symmetrical body 14 of revolution with a predetermined gap kept relative to the outside screen 7 and the symmetrical body 14 of revolution.

Incidentally, the symmetrical body 14 of revolution in the invention of claim 1 may include such ones as to be constructed by an inside screen 24 as shown in FIG. 3(A), as to be constructed by a plate-like member such as a sheet metal and as to be constructed by the symmetrical body 14 of revolution without an annular surface 20 as shown in FIG. 3(B). As shown in FIGS. 4(*x*)~(*z*), the outside screen 7 may include a cylindrical screen 18, a conical screen 27 of which diameter increases from its upper portion to its lower portion and an inverted conical screen 28 of which diameter decreases from its upper portion to its lower portion, and further various kinds of configurations as shown in FIGS. 13(A)–13(D) may be applicable to the outside screen 7.

The rotary blade 12 may be such a one as to agitate the granular material supplied into the annular space 15 and push the grains against the uniformizing openings 13. That is, it is enough if it performs the agitation and the pushing, and it is not limited in configuration and material. As the rotary blade 12 can be exemplified a pipe-like member, a plate member and so on besides a usual impeller. Incidentally, generally as for an arrangement direction of the revolution shaft 11 can be selected a vertical shaft 29.

According to the invention set forth in claim 1, when the granular material such as grains is supplied into the casing 3 through the supply opening 2, the rotary blade 12 agitates the granular material within the annular space 15 and pushes the granular material against the outer circumferential surface 8 having the uniformizing openings 3 to expel the uniformized granular product through the uniformizing openings 3 of the outer circumferential surface 8.

Herein, since the symmetrical body 14 of revolution of which diameter increases from its upper portion to its lower portion is arranged inside of the outside screen 7, as shown in FIG. 5, the granular material can move as outward flows 30 so as to be pushed against the outer circumferential surface 8 of the outside screen 7. Since the rotary blade 12 rotates keeping a predetermined distance relative to the outside screen 7 under that condition, the granular material is uniformized smoothly without any stagnation, so that the processing capacity can be increased in comparison with the conventional screen. Since there is provided the symmetrical body 14 of revolution, the granular material moves outward without soon dropping like in the single cylindrical screen so as to be pushed against the outer circumferential surface of the outside screen 7. Accordingly, since the granular material can be supplied efficiently near the outer circumferential surface of the outside screen 7, the granular material can be uniformized smoothly without any stagnation, so that the processing capacity can be increased in comparison with the conventional screen.

Further, since the rotary blade 12 is adapted to be rotated about the revolution shaft 11 within the annular space 15 formed between the outside screen 7 and the symmetrical body 14 of revolution with predetermined distances being kept relative to the outside screen 7 and the symmetrical body 14 of revolution respectively, a portion of the rotary blade 12 on the side of the outer circumferential surface 8 of the outside screen 7 is located remote from the revolution shaft 11. Therefore, the circumferential speed of the rotary blade 12 rotating at the bottom portion of the annular space 15 can be made large so that a scraping out force toward the outer circumferential surface 8 can be increased at the bottom portion of the annular space 15 where the granular material tends to gather due to gravity effect.

In the invention set forth in claim 2, for example as shown in FIG. 3(A), the symmetrical body 14 of revolution has an annular surface 20 to be connected to a lower portion of the outer circumferential surface of the outside screen 7.

According to the invention set forth in claim 2, since the symmetrical body 14 of revolution has the annular surface 20 to be connected to a lower portion of the outer circumferential surface of the outside screen 7, an acute angled portion is not formed at the bottom portion of the annular space 15, so that the granular material can be prevented from gathering at the acute angled portion.

In the invention set forth in claim 3, for example as shown in FIG. 3(A), the symmetrical body 14 of revolution is formed as an inside screen 24 provided with a large number of uniformizing openings 13.

According to the invention set forth in claim 3, since the symmetrical body 14 of revolution is formed as an inside screen 24 provided with a large number of uniformizing openings 13, the granular material can be ground and uniformized not only by the outside screen 7 but also by the inside screen 24, so that the processing capacity can be improved.

In the invention set forth in claim 4, for example as shown in FIG. 3(A), a large number of uniformizing openings 13 are formed also in the annular surface 20 of the symmetrical body 14 of revolution.

According to the invention set forth in claim 4, since the large number of uniformizing openings 13 are formed also in the annular surface 20 of the symmetrical body 14 of revolution, a screening area can be increased, so that the processing capacity can be enhanced.

In the invention set forth in claim 5, for example as shown in FIGS. 4(A)~(C), an inclination angle $\theta$ of an inclined surface 25 of the symmetrical body 14 of revolution relative to a vertical axis 62 is set larger than an inclination angle $\phi$, $\psi$ of the outer circumferential surface 8 of the outside screen 7.

According to the invention set forth in claim 5, since the inclination angle $\theta$ of the inclined surface 25 of the symmetrical body 14 of revolution relative to a vertical axis 62 is set larger than the inclination angles $\phi$, $\psi$ of the outer circumferential surface 8 of the outside screen 7, the annular space 15 becomes tapered so as to decrease its cross sectional area from its upper portion to its lower portion, so that the granular material can be made to flow toward the outer circumferential surface 8 in which the uniformizing openings 13 of the outside screen 7 are formed.

In the invention set forth in claim 6, for example as shown in FIG. 2, the outside screen 7 is a cylindrical screen 18.

According to the invention set forth in claim 6, by making the outside screen 7 the cylindrical screen 18, a circumferential speed of an outside portion 17*a* of the rotary blade 12 can be made constant and the uniformizing effect for the granular material can be made even in the vertical direction.

In the invention set forth in claim 7, for example as shown in FIG. 2, the symmetrical body 14 of revolution has a conical circumferential surface 19 of which diameter becomes larger from its upper portion to its lower portion.

According to the invention set forth in claim 7, by arranging the symmetrical body 14 of revolution having its diameter becoming larger from its upper portion to its lower portion, the manufacturing can be made readily and it becomes possible to smoothly carry out such an action as to direct the granular material toward the outer circumferential surface 8 of the outside screen 7.

In the invention set forth in claim 8, for example as shown in FIG. 4(z), the outside screen 7 is an inverted conical screen 28 of which diameter becomes smaller from its upper portion to its lower portion.

According to the invention set forth in claim 8, by making the outside screen 7 the inverted conical screen 28 of which diameter becomes smaller from its upper portion to its lower portion, the uniformized granular product expelled from the inverted conical screen 28 drops readily downward.

In the invention set forth in claim 9, for example as shown in FIG. 12, the rotary blade 12 has such a cross section as to bend at its middle and an opening 51 formed at the middle of a blade 16 with outer edge portions 17 of the rotary blade 12 remained as a frame.

According to the invention set forth in claim 9, since the rotary blade 12 has such a cross section as to bend at its middle, it is possible to secure a suitable rubbing angle relative to the outside screen 7 and to obtain a strong blade configuration in spite of the decreasing of its weight. Further, by forming the opening 51 at the middle of the blade 16 with outer edge portions 17 of the rotary blade 12 remaining as a frame, it is possible to allow the granular material except the material scraped out toward the uniformizing openings 13 of the outer circumferential surface 8, to pass through the opening 51 to restrain a heat generation which might be caused by an excessive agitation against the granular material.

In the invention set forth in claim 10, for example the outside screen 7 is a rotationally symmetrical screen formed by rotating a segment including at least one of a straight line and a curved line about the revolution shaft 11.

According to the invention set forth in claim 10, since the outside screen 7 is the rotationally symmetrical screen formed by rotating the segment including at least one of the straight line and the curved line about the revolution shaft 11, the outside screen 7 can be formed in various kinds of configurations as exemplified in FIGS. 4 and 13.

In the invention set forth in claim 11, for example the symmetrical body 14 of revolution is a symmetrical body of revolution formed by rotating a segment including at least one of a straight line and a curved line about the revolution shaft 11.

According to the invention set forth in claim 11, since the symmetrical body 14 of revolution is a symmetrical body of revolution formed by rotating a segment including at least one of a straight line and a curved line about the revolution shaft 11, the symmetrical body 14 of revolution (including the inside screen 24) can be formed in various kinds of configurations as exemplified in FIGS. 4 and 13.

In the invention set forth in claim 12, for example as shown in FIGS. 7 and 8, the apparatus comprises the casing 3, a double screen 42 and the rotary blade 12. The casing 3 has the vertical revolution shaft 11 inserted into its upper portion and the supply opening 2 for the granular material formed at its upper portion, and is opened downward. The double screen 42 comprises the cylindrical screen 18 and the conical screen 23. The cylindrical screen 18 is opened toward the casing 3 at its upper portion and provided with a large number of uniformizing openings 13. The conical screen 23 is arranged coaxially with the cylindrical screen 18, has its diameter increasing from its upper portion to its lower portion and is provided with a large number of uniformizing openings 13. The cylindrical screen 18 and the conical screen 23 are connected to each other adjacent to their lower sides to construct one unit screen. The rotary blade 12 is rotated about the revolution shaft 11 with predetermined gaps kept relative to the cylindrical screen 18 and the conical screen 23 respectively within the annular space 15 defined between the cylindrical screen 18 and the conical screen 23.

According to the invention set forth in claim 12, since there is provided the double screen 42 comprising the cylindrical screen 18 opened toward the casing 3 at its upper portion and provided with a large number of uniformizing openings 13 and the conical screen 23 arranged coaxially with the cylindrical screen 18, having its diameter increasing from its upper portion to its lower portion and provided with a large number of uniformizing openings 13, it is possible to direct the granular material so as to flow toward the circumferential surface 8 of the outside screen 7, to improve a scraping out action of an outside portion 17*a* of the rotary blade 12 rotating at a high speed, to perform the grinding and uniformizing by both the outside cylindrical screen 18 and the inside conical screen 23, and to improve the processing capacity by the increasing of the screening area.

Further, since the rotary blade 12 is rotated about the revolution shaft 11 with predetermined gaps kept relative to the outside screen 7 and the symmetrical body 14 of revolution respectively within the annular space 15 defined between the cylindrical screen 18 and the conical screen 23, the outside portion 17*a* of the rotary blade 12 on the side of the circumferential surface 8 of the cylindrical screen 18 is located remote from the revolution shaft 11. Therefore, it is possible to increase the circumferential speed of the rotary blade 12 rotating at the bottom portion of the annular space 15 and to increase an expelling force against the circumferential surface 8 at the bottom portion of the annular space 15 where the granular material tends to gather due to the gravity effect. Further, it is possible to make constant the speed of the outside portion 17*a* of the rotary blade 12 and to make even the uniformizing action for the granular material in the vertical direction.

In the case of the screen constructed only by the cylindrical screen 18, since the screen has only a cylindrical surface and therefore a circular bottom portion with no uniformizing opening 13 is formed, it is impossible to expel the granular material gathering at the circular bottom portion even though the rotary blade 12 is made to rotate no matter how much it is rotated. On the contrary, according to the invention of claim 12, advantageously it is possible to uniformize the granular material by both the cylindrical screen 18 and the conical screen 23.

In the invention set forth in claim 13, for example as shown in FIG. 8, the double screen 42 is attached to the lower portion of the casing 3 at the upper opening of the cylindrical screen 18.

According to the invention set forth in claim 13, since the double screen 42 is attached to the lower portion of the casing 3 at the upper opening of the cylindrical screen 18, the whole of the apparatus for grinding and uniformizing the grains can be made compact in its height direction.

In the invention set forth in claim 14, for example as shown in FIG. 10, the annular surface 20 for connecting the cylindrical screen 18 to the conical screen 23 comprises an annular screen 35 provided with a large number of uniformizing openings 13.

According to the invention set forth in claim 14, since the annular surface 20 for connecting the cylindrical screen 18 to the conical screen 23 in the double screen 42 further provides the annular screen 35 provided with the large number of uniformizing openings 13, it is possible to increase a screening area and to scrape out efficiently also the granular material dropping to the bottom of the annular space 15 by the lower end portion of the rotary blade 12 rotating at the high circumferential speed.

In the invention set forth in claim 15, for example as shown in FIG. 10, the cylindrical screen 18 and the conical screen 23 are detachable from each other at the connection portion of the annular screen 35.

According to the invention set forth in claim 15, since the cylindrical screen 18 and the conical screen 23 of the double screen 42 are detachable from each other at the connection portion of the annular screen 35, it is possible to exchange only a screen portion damaged during the process and to therefore carry out the maintenance economically.

In the invention set forth in claim 16, for example as shown in FIGS. 8 and 11, the rotary blade 12 is attached to the revolution shaft 11 through an adjustment metal piece (an adjustment tubular member 52) of which thickness can be set changeably so as to be adjusted relative to the revolution shaft 11.

According to the invention set forth in claim 16, since the rotary blade 12 is attached to the revolution shaft 11 through the adjustment metal piece 52, it is possible to readily adjust a gap between the conical screen 23 and an outer edge portion 17 of the blade 16.

In the invention set forth in claim 17, for example as shown in FIG. 8, the double screen 42 is attached to the casing 3 through an adjustment washer (a ring-like adjustment washer 53) of which thickness can be set changeably so as to be adjusted relative to the casing 3.

According to the invention set forth in claim 17, since the double screen 42 is attached to the casing 3 through the ring-like adjustment washer 53, it is possible to readily adjust a gap between the conical screen 23 and the outer edge portion 17 of the blade 16.

In the invention set forth in claim 18, for example as shown in FIGS. 1 and 2, a screen with an annular working space (referred to as an annular space screen hereinafter) 13 comprises an outside screen 7 of which outer circumferential surface 8 is provided with a large number of uniformizing openings 13 and which is rotationally symmetrical relative to a revolution shaft 11 and a symmetrical body 14 of revolution which is disposed inside of the outside screen 7 and coaxially with the outside screen 7 and of which diameter increases from its upper portion to its lower portion so that an annular space 15 having a nearly V-shaped cross section between the outside screen 7 and the symmetrical body 14 of revolution.

Incidentally, the symmetrical body 14 of revolution in the invention set forth in claim 18 may be constructed by the inside screen 23 as shown in FIG. 10, by the one with the annular surface 20 or by the one without the annular surface 20.

According to the invention set forth in claim 18, since the annular space screen is previously constructed by the outside screen 7 and the symmetrical body 14 of revolution so as to form the annular space 15 between the outside screen 7 and the symmetrical body 14 of revolution, it is possible to readily construct the grinding and uniformizing apparatus according to claims 1 through 15. When several kinds of annular space screens having the uniformizing openings of different sizes are prepared, it is possible to accomplish the granulating function in accordance with the various kinds of granular materials. Further, as shown in FIGS. 4 and 13, when several kinds of annular space screens having different configurations of the outside screen 7 and different configurations and species (classification of the screen type or the plate type) of the symmetrical body 14 of revolution are prepared as well as rotary blades, lower casings and so on are prepared in accordance with the respective annular space screens, it is possible to readily change the kinds of granular materials to be uniformized and the uniformizing performance of the apparatus per unit time.

In the invention set forth in claim 19, for example as shown in FIGS. 16 and 17, a ring 67 to be accommodated in a lower portion of the annular space 15 is fixedly secured to the lower end of the rotary blade 12, at least one cutter vane 70 is fixedly secured to the ring 67, and the cutter vane 70 is slanted within a range of 5~45 degree toward the revolution lagged direction with respect to the radial line 69 passing through the revolution center 68 of the ring 67.

According to the invention set forth in claim 19, since lumps within the granular material tending to gather in the lower portion of the annular space 15 can be ground more effectively by the cutter vane 70 fixedly secured to the ring 67. Further, since the cutter ring 70 is slanted within a range of 5~45 degrees toward the revolution lagged direction with respect to the radial line 69 passing through the revolution center 68 of the ring 6, it is possible to intensify an action for rubbing the granular material against the inside surface of the screen.

In the invention set forth in claim 20, for example as shown in FIGS. 18 through 21, at least one piece of band plate 76 extending generally in the direction of a generatrix line 77, 78 of each screen 18, 23 is fixedly secured to the surface of the screen 18, 23 opposed to the rotary blade 12.

According to the invention set forth in claim 20, when the granular material passes through the screens 18, 23 sliding somewhat along the inside surfaces of the screens 18, 23 during the revolution of the rotary blade 12, the band plate 76 can prevent the over sliding of the granular material along the inside surfaces of the screens 18, 23 to increase an amount of the granular material passing through the screens 18, 23 so as to be ground and uniformized therethrough.

DESCRIPTION OF THE PREFERRED EMBODIMENTS

<First Embodiment>

The present invention will be explained in detail with reference to attached drawings showing embodiments hereinafter.

Figure 1:
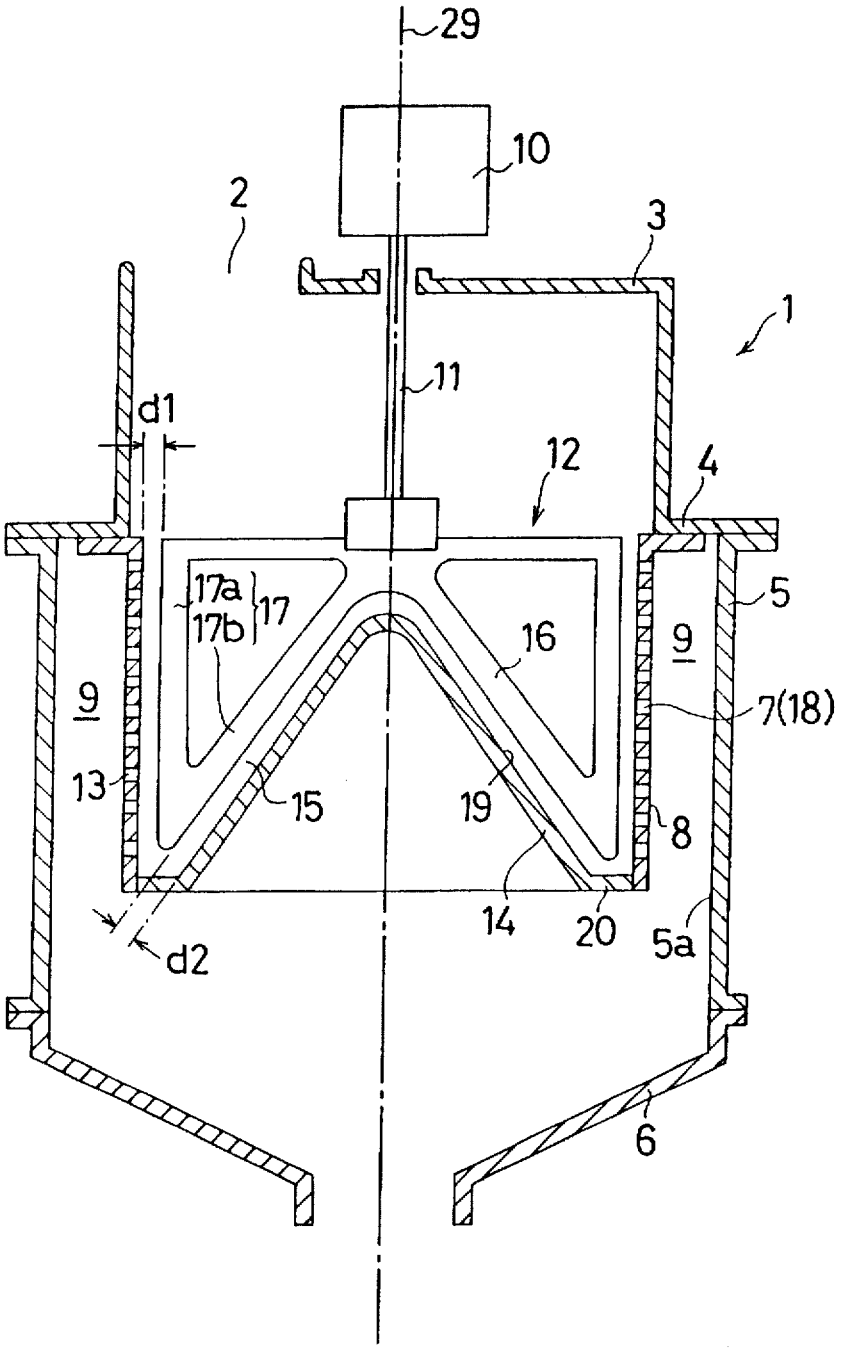
FIG. 1 is a schematic structural view showing a first embodiment of an apparatus for grinding and uniformizing grains according to the present invention.

FIG. 1 is a schematic structural view showing a first embodiment of an apparatus for grinding and uniformizing grains according to the present invention.

This grinding and uniformizing apparatus 1 includes an upper casing 3 having a supply opening 2 at its left upper portion and a lower casing 5 attached to a lower flange 4 of the upper casing 3. The upper casing 3 and the lower casing 5 are substantially round in the horizontal cross-section. A hopper 6 for collecting uniformized granular product is mounted to the lower side of the lower casing 5. An outside screen 7 is attached to the lower flange 4 of the upper casing 3. An external diameter of the outside screen 7 is smaller than an internal diameter of the lower casing 5, and a delivery passage 9 is formed annularly between an outer circumferential surface 8 of the outside screen 7 and an inside surface 5*a* of the lower casing 5 so that the uniformized granular product which has passed through uniformizing openings 13 of the outer circumferential surface 8 drops toward the hopper 6 along the delivery passage 9.

A motor 10 is disposed above the upper casing 3, and a revolution shaft 11 is vertically connected to the motor 10 so as to pass through an upper wall of the upper casing 3. A rotary blade 12 is detachably connected to a leading end of the revolution shaft 11.

Figure 2:
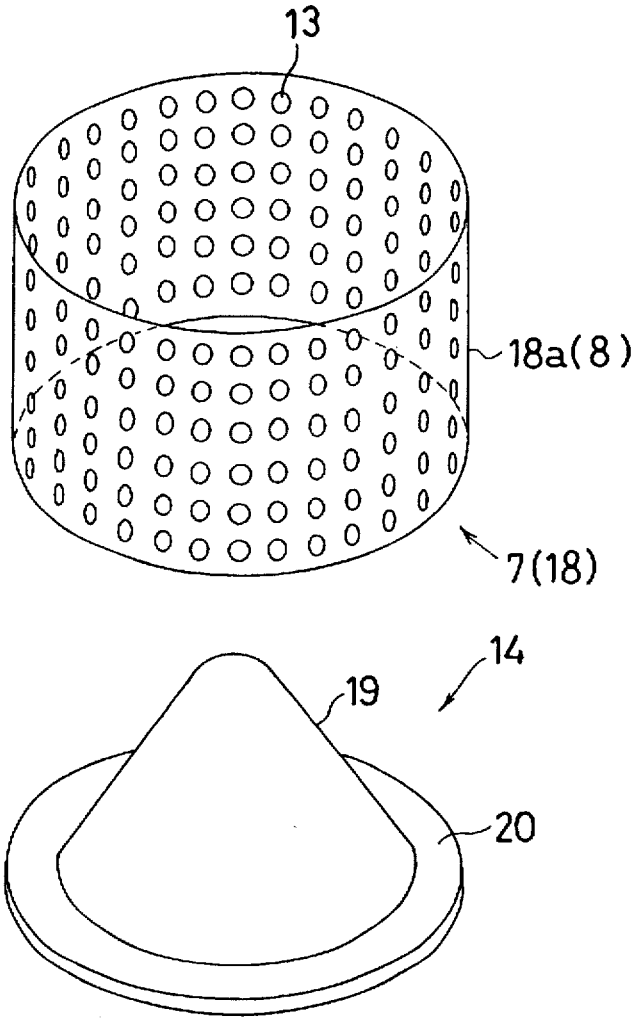
FIG. 2 is a perspective view showing one example of a combination of an outside screen and a symmetrical body of revolution.

The outside screen 7 is rotationally symmetrical with respect to the revolution shaft 11 and has a large number of uniformizing openings 13 formed in its outer circumferential surface 8 as shown in FIG. 2.

Inside of the outside screen 7 there is provided a symmetrical body 14 of revolution which is rotationally symmetrical with respect to the revolution shaft 11 and of which diameter increases from its upper portion to its lower portion. The rotary blade 12 attached to the revolution shaft 11 is disposed within an upper inside annular space 15 formed between the outside screen 7 and the symmetrical body 14 of revolution.

The rotary blade 12 includes at least one blade 16 having an outer edge portion 17 substantially similar to the vertical sectional figure of the annular space 15 and is rotated keeping a gap d1 between an outside portion 17*a* of the blade 16 and the outer circumferential surface 8 of the outside screen 7 and a gap d2 between an inside portion 17*b* of the blade 16 and the symmetrical body 14 of revolution.

FIG. 2 is a perspective view showing one example of a combination of the outside screen 7 and the symmetrical body 14 of revolution. The outside screen 7 comprises a cylindrical screen 18, and the symmetrical body 14 of revolution is constructed by attaching an annular surface 20 to a conical circumferential surface 19. A large number of round uniformizing openings 13 are formed in an entire cylindrical surface 18*a* of the outside screen 7. The uniformizing opening 13 is not formed in the symmetrical body 14 of revolution.

Figure 3:
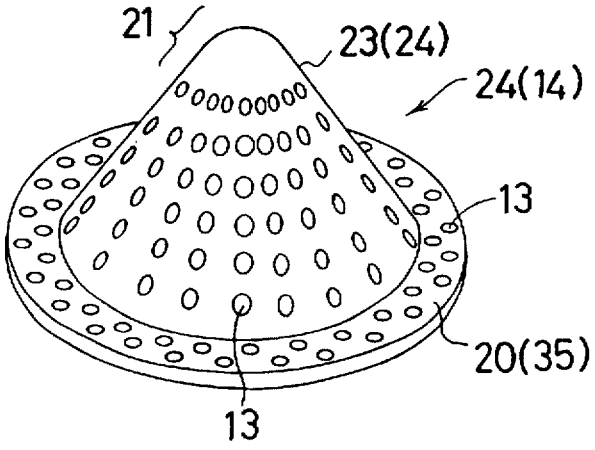
FIG. 3(A) is a perspective view showing the symmetrical body of revolution constructed by a conical screen and an annular surface.
FIG. 3(B) is a perspective view showing the construction the symmetrical body of revolution without the annular surface.
Figure 3:
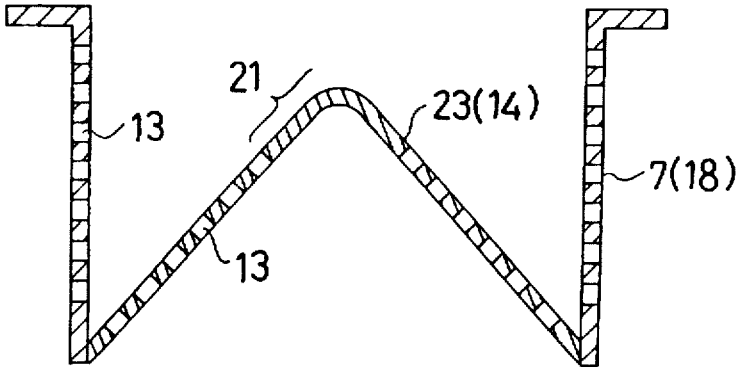

FIG. 3(A) is a view showing the symmetrical body 14 of revolution constructed by a conical screen 23 and the annular surface 20 (an annular screen 35) in which the uniformizing openings 13 are formed. When the symmetrical body 14 of revolution is constituted from an inside screen 24 in this way, the granular material can be uniformized not only by the outside screen 7 but also by the inside screen 24. Since a circumferential speed of the rotary blade 12 is not high at its top area 21 of the inside screen 24, the top area 21 has no openings so as not to serve as a screen because the uniformizing action can't be obtained enough there.

The inside screen 24 is not always limited to the one with the annular surface 20, but may be constructed by directly connecting the lower circumferential end of the conical screen 23 to the lower circumferential end of the outside screen 7 as shown by the vertical sectional view in FIG. 3(B).

Next, the selecting of the outside screen 7 and the symmetrical body 14 of revolution in this embodiment will be explained with reference to FIGS. 4(A)~(C) and FIGS. 4(*x*)~(*z*).

Figure 4:
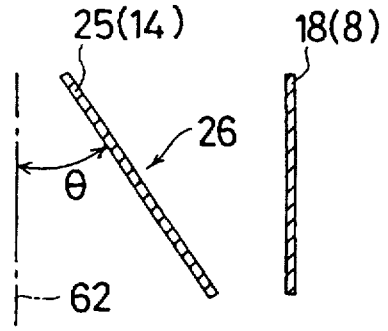
FIGS. 4(A), (B), (C) and FIGS. 4(*x*), (*y*), (*z*) are views for explaining selections of the outside screens and the symmetrical bodies of revolution in the first embodiment respectively.
Figure 4:
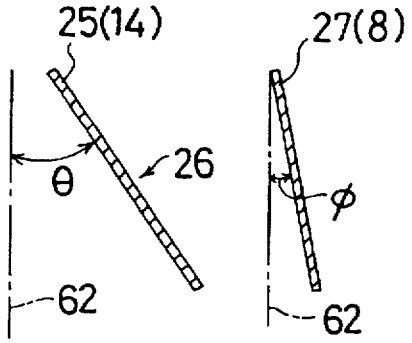
Figure 4:
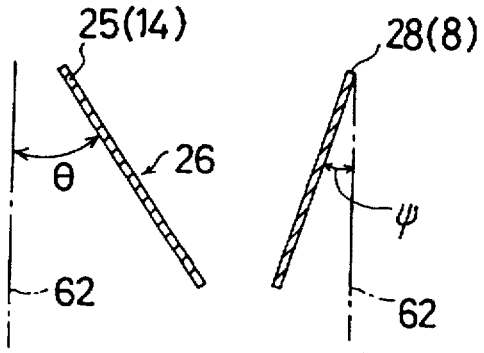
Figure 4:
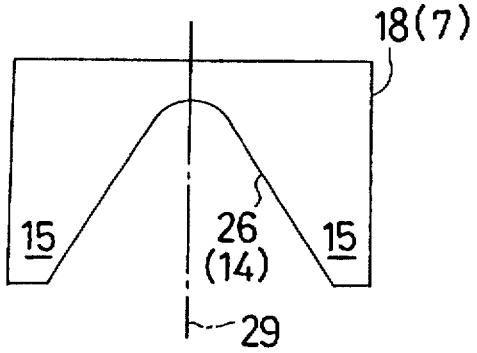
Figure 4:
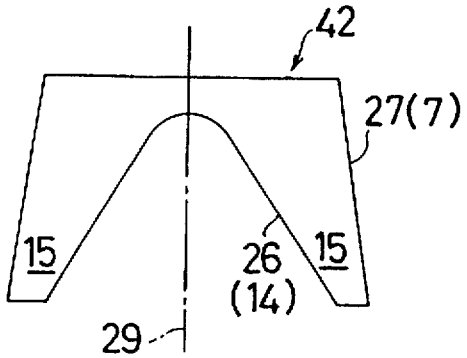
Figure 4:
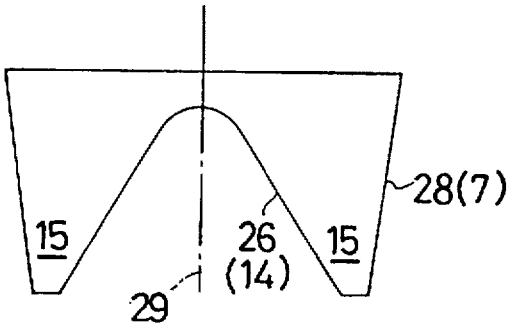

FIGS. 4(A), (B), (C) are views showing inclination angles of an inclined surface 25 of the symmetrical body 14 of revolution arranged inside thereof and of the outer circumferential surface 8 of the outside screen 7. FIG. 4(A) is a view showing a combination of a conical symmetrical body 26 of revolution of which diameter increases from its upper portion to its lower portion and the cylindrical screen 18, FIG. 4(B) is a view showing a combination of a conical symmetrical body 26 of revolution and a conical screen 27 of which diameter increases from its upper portion to its lower portion, and FIG. 4(C) is a view showing a combination of the conical symmetrical body 26 of revolution and an inverted conical screen 28 of which diameter decreases from its upper portion to its lower portion. FIGS. 4(*x*), (*y*), (*z*) are views showing schematic configurations of the annular space screen (double screen 42) formed by the inclined surface 25 and the outer circumferential surface 8 of the outside screen 7 shown in FIGS. 4(A), (B), (C) respectively. Incidentally, the symmetrical body 14 of revolution may be constructed by the screen or also by a surface having no uniformizing openings 13.

Herein, though it is common to the embodiment shown in FIG. 4 that the symmetrical body 4 of revolution can be constructed in a symmetrical figure of revolution of which diameter increases from its upper portion to its lower portion, the annular space screen may employ such modes, for example as shown in FIGS. 4(*x*)~(*z*) in consideration of a relationship between the inclination angle of the outer circumferential surface 8 of the outside screen 7 and the angle of the inclined surface 25 of the symmetrical body 14 of revolution. A matter common to the constructions shown in FIGS. 4(*x*)~(*z*) is that the inclination angle of the inclined surface 25 of the symmetrical body 14 of revolution with respect to a vertical line 62 is set larger than the inclination angle of the outer circumferential surface 8 of the outside screen 7. That is, $\theta>0$ (the vertical line 62 coincides with the outer circumferential surface 8) in FIG. 4(A), $\theta>\phi$, in FIG. 4(B), and $\theta>(-\psi)$ in FIG. 4(C). Incidentally, the inclination angle is measured including its direction.

When the inclination angle θ of the inclined surface 25 of the symmetrical body 14 of revolution is set larger than the inclination angles ϕ, ψ of the outer circumferential surface 8 of the outside screen 7, the annular space 15 is tapered so as to decrease its horizontal cross-sectional area from its upper portion to its lower portion. Thereupon, the granular material flows from the central side of the symmetrical body 14 of revolution to the outer circumferential surface 8 of the outside screen 7, so that advantageously the uniformizing action can be performed effectively.

Figure 5:
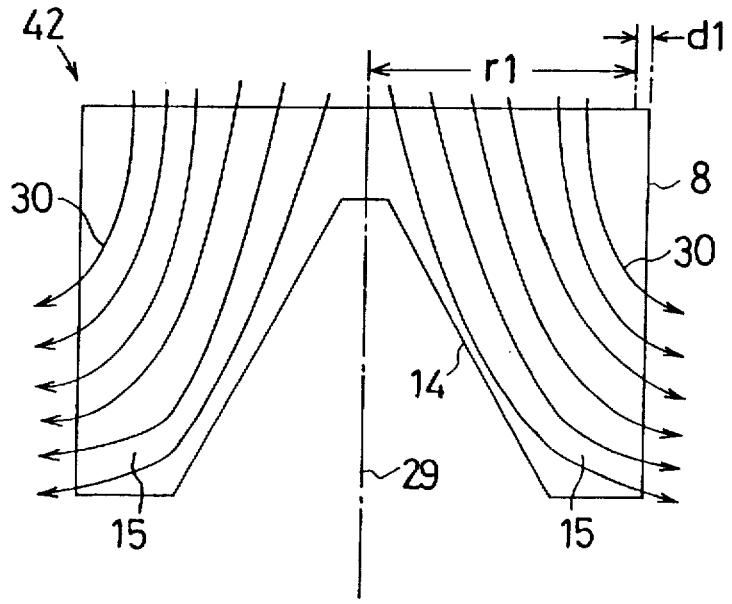
FIG. 5 is a view for explaining a basic conception of the first embodiment.

FIG. 5 is a view illustrating a concept of the annular space screen (for example, the double screen 42). When the symmetrical body 14 of revolution is constructed so that its diameter increases from its upper portion to its lower portion, as shown in FIG. 5, the granular material supplied from above flows to the outer circumferential surface 8 of the outside screen 7 as indicated by arrows 30 to assist the uniformizing action performed by a centrifugal force of the rotary blade at the outer circumferential surface 8. When the symmetrical body 14 of revolution is disposed within the outside screen 7, the tapered annular space 15 is obtained, so that the granular material flowing to the outer circumferential surface 8 as indicated by the arrows 30 can be uniformized at a location where the circumferential speed of the blade of the rotary blade is high (r1 is large).

Figure 6:
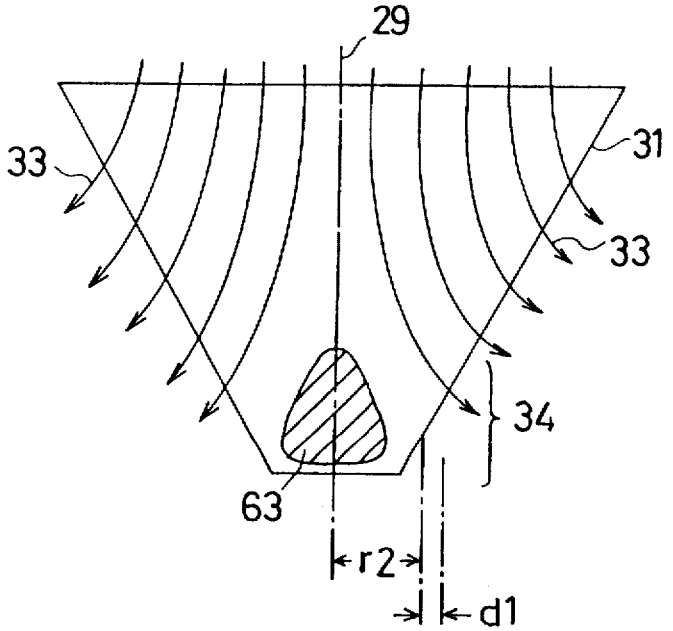
PRIOR ART F I G. 6
FIG. 6 is a view for explaining problems of a conventional inverted conical screen.

To the contrary, in the case of a conventional inverted conical screen 31 as shown in FIG. 6, the granular material supplied from above flows as indicated by arrows 33. Thereupon, since the circumferential speed of the rotary blade is low at the bottom area 34 (r2 is small), an amount of the uniformized granular product expelled from the uniformizing openings at the bottom area 34 is decreased, so that the granular material stagnates there. Therefore, a dead space 63 where the granular material stagnates is enlarged with the lapse of time, the processing capacity is decreased, and the eveness of the uniformizing effect is also lowered. According to this embodiment, since the outside portion 17*a* of the rotary blade 12 rotating in proximity to the outer circumferential surface 8 of the outside screen 7 as shown in FIG. 1 has a large radius, it becomes possible to blow and push the granular material onto the outer circumferential surface 8 by the centrifugal force. Thereupon, it is unnecessary to adjust a gap d1 between the outside portion 17*a* of the rotary blade 12 and the outer circumferential surface 8 strictly like in the conventional grinding and uniformizing apparatus. That is, since the uniformizing action can be regulated by adjusting the centrifugal force by mainly changing the revolution speed of the rotary blade 12, advantageously it becomes possible to simplify the adjustment in comparison with the gap adjustment in the conventional apparatus.

<Second Embodiment>

Figure 7:
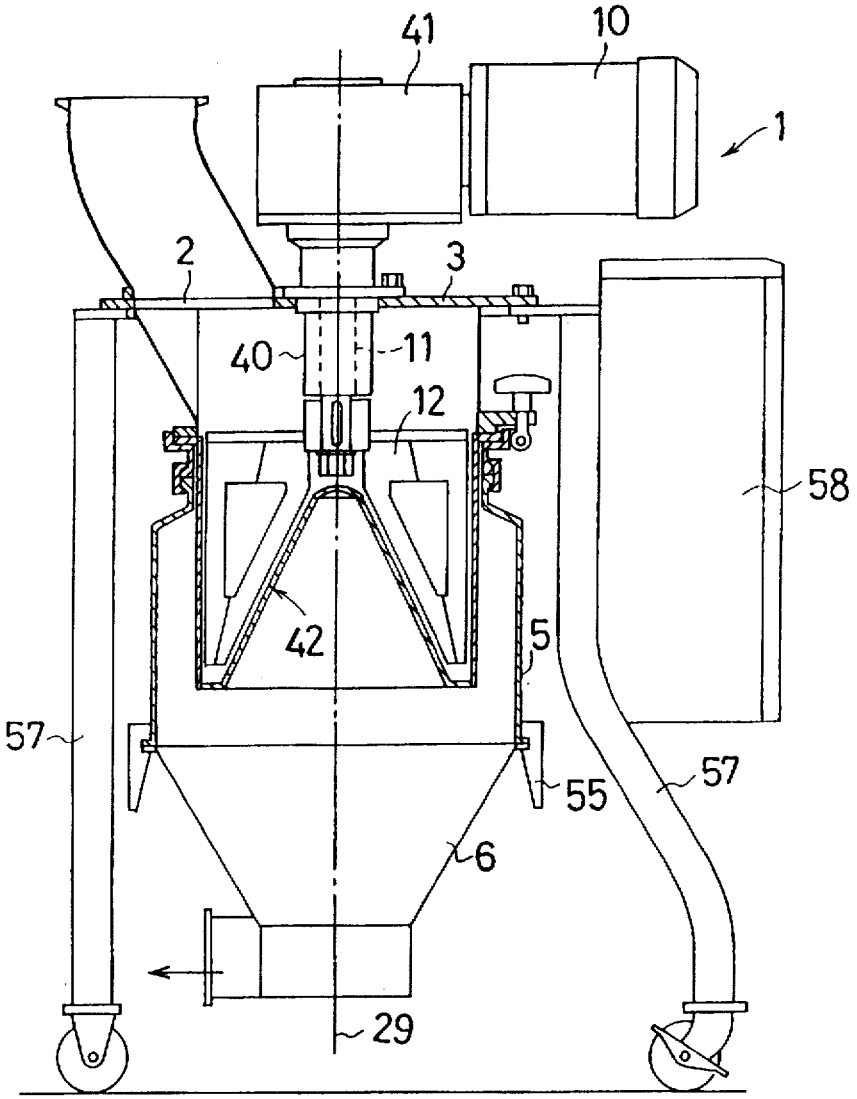
FIG. 7 is a partial vertical sectional front view showing a second embodiment of an apparatus for grinding and uniformizing grains according to the present invention.
Figure 8:
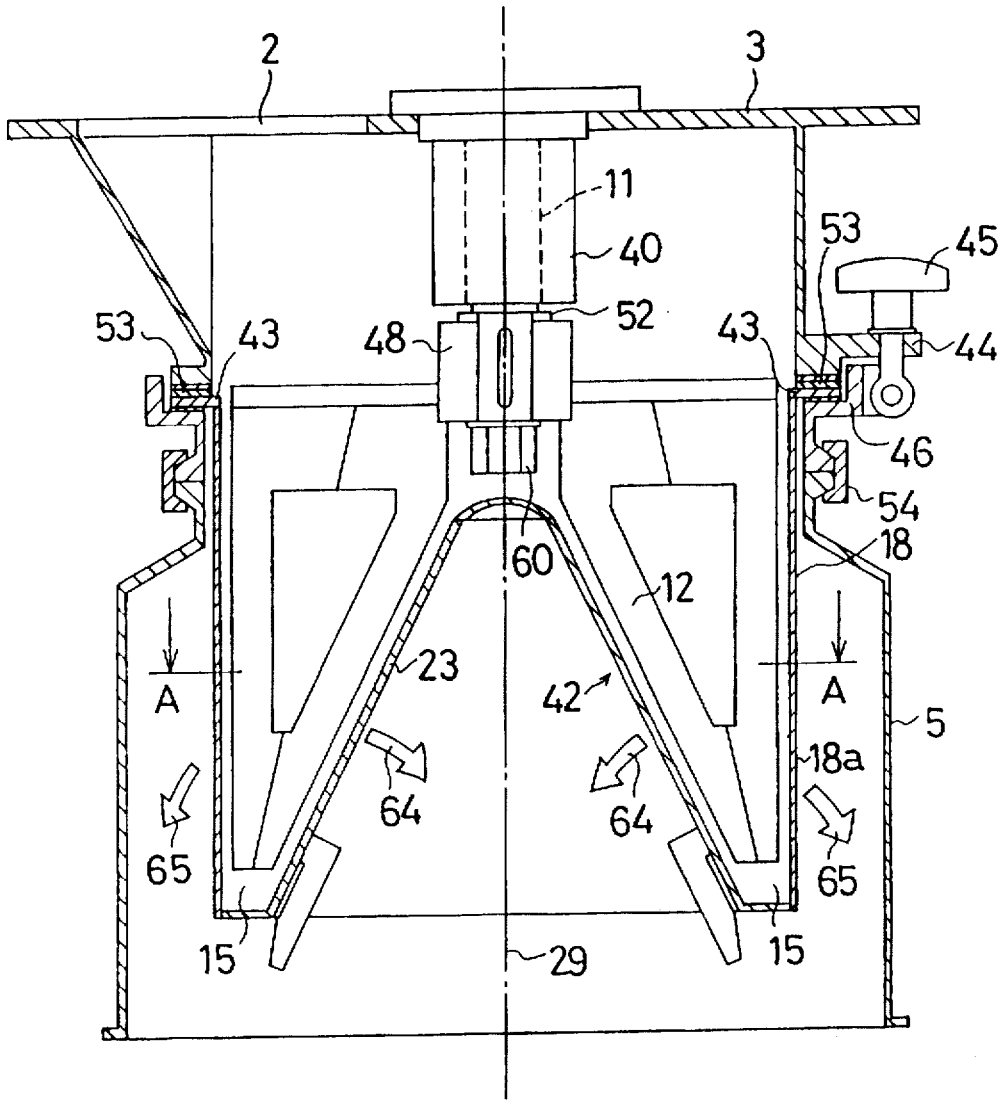
FIG. 8 is an enlarged view of a principal portion of the second embodiment.
Figure 9:
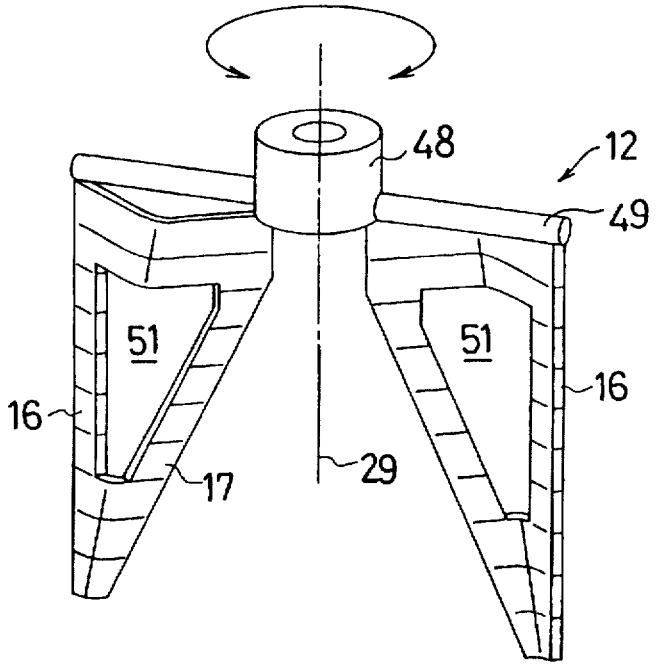
FIG. 9 is a perspective view of a rotary blade.
Figure 10:
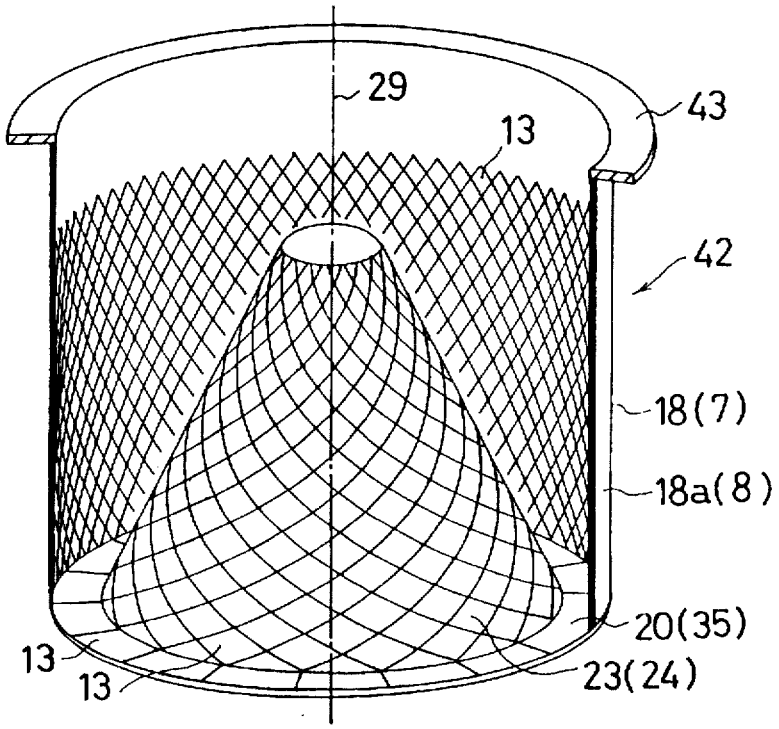
FIG. 10 is a partially fragmentary perspective view of a double screen.
Figure 11:
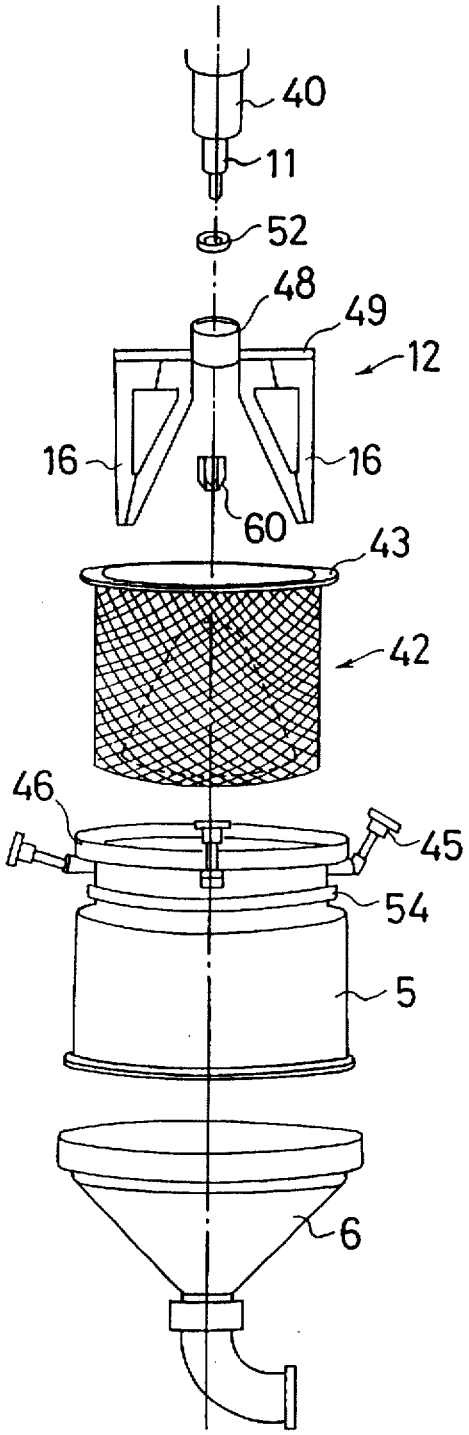
FIG. 11 is an exploded view showing principal component parts of the apparatus for grinding and uniformizing grains according to the second embodiment of the present invention.
Figure 12:
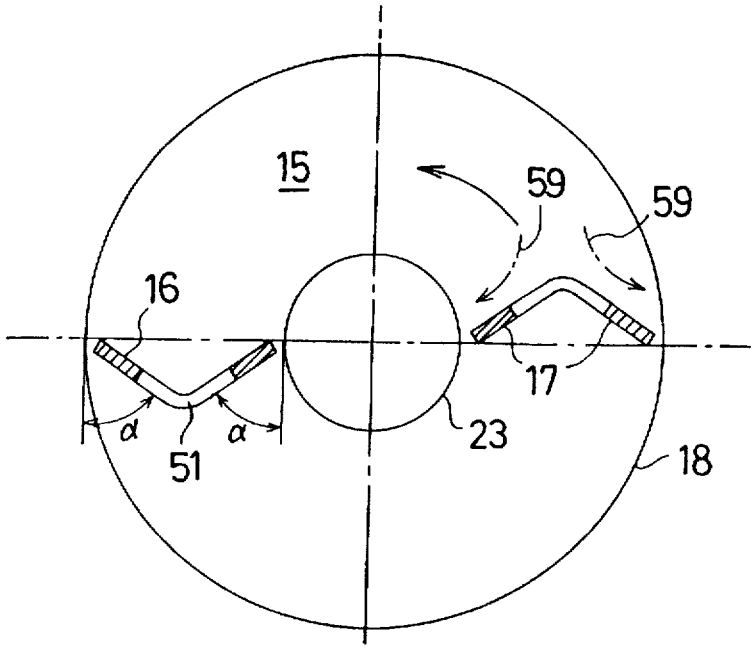
FIG. 12 is a schematic horizontal sectional view taken along the A—A line in FIG. 8.

FIG. 7 is a partial vertical sectional front view showing a second embodiment of a grinding and uniformizing apparatus according to the present invention; FIG. 8 is an enlarged view of a principal portion thereof; FIG. 9 is a perspective view of a rotary blade; FIG. 10 is a partially fragmentary perspective view of a double screen; FIG. 11 is an exploded view showing principal component parts of the grinding and uniformizing apparatus; and FIG. 12 is a schematic horizontal sectional view taken along the A—A line in FIG. 8.

In FIG. 7, the grinding and uniformizing apparatus includes the upper casing 3 having the grain supply opening 2 at its left upper portion. The vertical revolution shaft 11 (the drive shaft) to be driven by the motor 10 through a reduction gear device 41 is inserted into an upper portion of the upper casing 3. The revolution shaft 11 is covered with an air seal tube 40 so that the air can be supplied between the revolution shaft 11 and the air seal tube 40 from above to below to prevent the intrusion of the granular material into the reduction gear device 41. The motor 10, the reduction gear device 41 and the upper casing 3 are supported by a frame 57 provided with casters, and a control box 58 for controlling the driving, the stopping, the revolution speed and so on of the grinding and uniformizing apparatus is arranged at the side portion of the frame 57.

The lower portion of the upper casing 3 is opened downward, and the double screen 42 is attached to the upper casing 3 directly or through a separate member.

As shown in FIG. 10, the double screen 42 is opened upward, namely toward the upper casing 3 and comprises the cylindrical screen 18 having a large number of uniformizing openings 13 formed in its cylindrical surface 18*a* as the outer circumferential surface 8, the conical screen 23 arranged coaxially with the cylindrical screen 18, having a diameter increased from its upper portion to its lower portion with its top area closed and having a large number of uniformizing openings 13 formed in its conical surface, the annular screen 35 which connects the cylindrical screen 18 and the conical screen 23 at their lower ends, and a mounting flange 43 attached to the upper edge of the cylindrical screen 18.

As shown in FIG. 8, a flange 44 is attached to the lower end of the upper casing 3 so that this flange 44 can hold a gasket (not illustrated) and the mounting flange 43 of the double screen 42 together with a holding-down flange 46 provided with swingable bolts 45 to secure the double screen 42 to the upper casing 3. Incidentally, the lower casing 5 is fixedly secured to the lower portion of the holding-down flange 46 by a connecting member 54, and the hopper 6 is detachably mounted to the lower portion of the lower casing 5 by a clamp member 55 (refer to FIG. 7).

As shown in FIGS. 9 and 11, the rotary blade 12 has a straight stay 49 fixedly secured to a tublar member 48 perpendicularly thereto through which the revolution shaft 11 is fitted and has two blades 16 secured to opposite side portions of the stay 49 in the hanging manner. The blade 16 has such a configuration as corresponding to the annular space 15 having the nearly V-shaped cross-section between the cylindrical screen 18 and the conical screen 23 of the double screen 42. That is, the blade 16 is tapered in the direction of the revolution shaft so as to be able to rotate keeping a necessary gap relative to the cylindrical screen 18, the conical screen 23 and the annular surface 20. The horizontal cross-section of the blade 16 is formed like "<" which is bent at its middle as shown in FIG. 12, and the blade 16 has an opening 51 formed at its central portion with its outer edge portion 17 remained. When the outer edge portion 17 bent like "<" is rotated within the annular space 15, the granular material is blown in the direction indicated by a arrow 59 to be pushed onto the outer circumferential surfaces of the two screens at a predetermined rubbing angle α.

As shown in FIGS. 8 and 11, the revolution shaft 11 is fitted through a tubular member 48, and the rotary blade 12 is fixedly secured to the revolution shaft 11 by tightening the tubular member 48 with a fixing nut 60. Herein, since the tubular member 48 of the rotary blade 12 is attached to the revolution shaft 11 with an adjustment tubular member 52 held therebetween, it is possible to readily adjust a gap between the conical screen 23 and the blade 16 of the rotary blade 12 by preparing the plural kinds of adjustment tubular member 52 having different thicknesses.

As shown in FIG. 8, an adjustment washer (for example, an annular adjustment washer 53) of which thickness can be changeably set is interposed between the mounting flange 43 of the double screen 42 and the flange 44 of the upper casing 3 so that an attachment position of the double screen 42 relative to the upper casing 3 can be adjusted. Also in this case, a gap between the conical screen 23 and the blade 16 of the rotary blade 12 can be adjusted.

The function of the grinding and uniformizing apparatus having the above-mentioned construction will be briefly explained hereinafter.

In FIG. 7, when the motor 10 is driven, the revolution shaft 11 is rotated through the reduction gear device 41 so that the rotary blade 12 attached to the revolution shaft 11 can rotate. When the granular material is supplied from the supply opening 2, the granular material drops from the supply opening 2 into the annular space 15 having the nearly V-shaped cross-section between the cylindrical screen 18 and the conical screen 23 of the double screen 42 through the upper casing 3. When the rotary blade 12 is rotated, the granular material is expelled by the blades 16 projected into the annular space 15 so as to pass through the large number of uniformizing openings 13 formed in the cylindrical screen 18 and the conical screen 23 respectively being ground and uniformized (as indicated by arrows 64, 65 in FIG. 8) to drop into the hopper through the lower casing 5 and then to be discharged by means of pneumatic conveyance.

<Third Embodiment>

Figure 16:
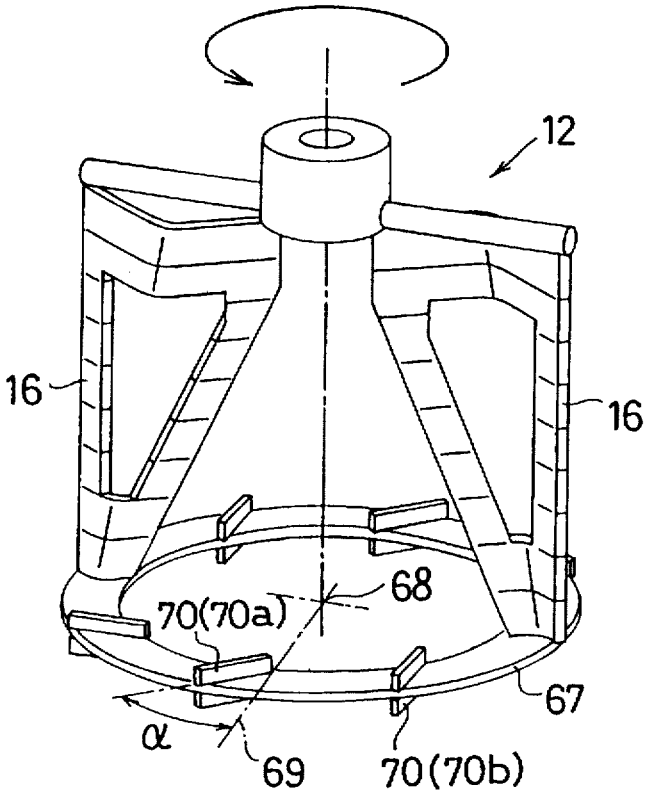
FIG. 16 is a perspective view of a rotary blade showing a third embodiment of the present invention.

FIG. 16 is a perspective view of the rotary blade showing a third embodiment of the present invention; FIG. 17(A) is a sectional view showing schematically a condition that the rotary blade of this embodiment is accommodated within the annular space of the double screen; and FIG. 17(B) is an enlarged view of the encircled B in FIG. 17(A).

Figure 13:
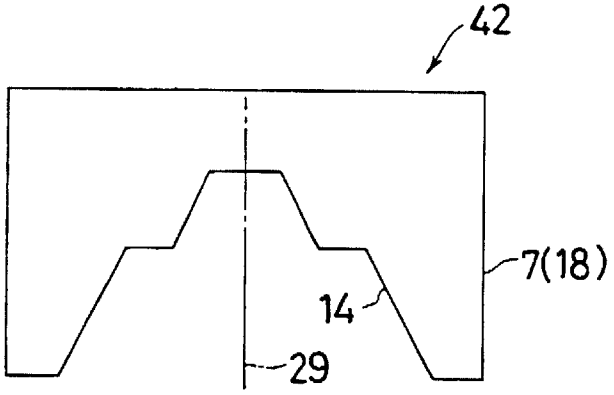
FIGS. 13(A), (B), (C), (D) are views for explaining other embodiments of the present invention respectively.
Figure 13:
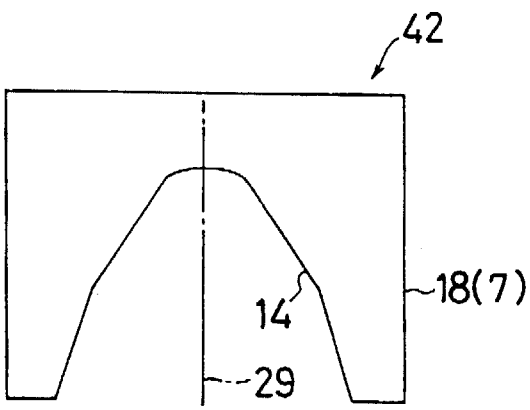
Figure 13:
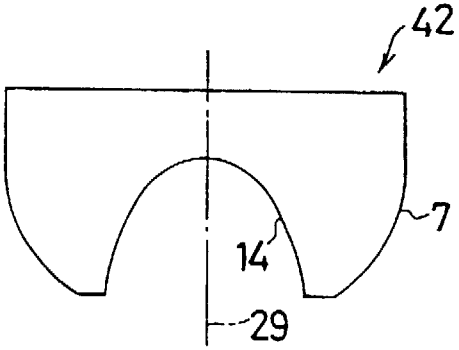
Figure 13:
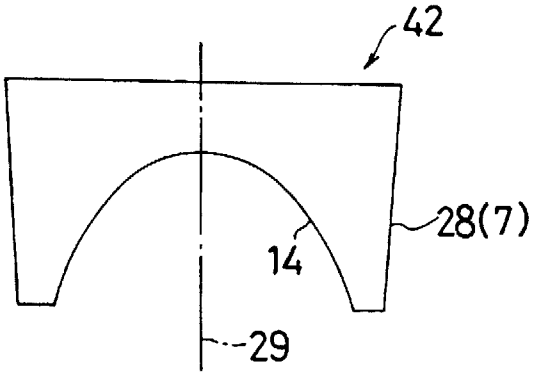

A feature of this embodiment is that the construction of the rotary blade 12 is modified, and the grinding and uniformizing apparatus and the screen can employ the constructions explained in the first and the second embodiments (for example, the constructions shown in FIG. 4 and FIG. 13 and so on) optionally.

Figure 17:
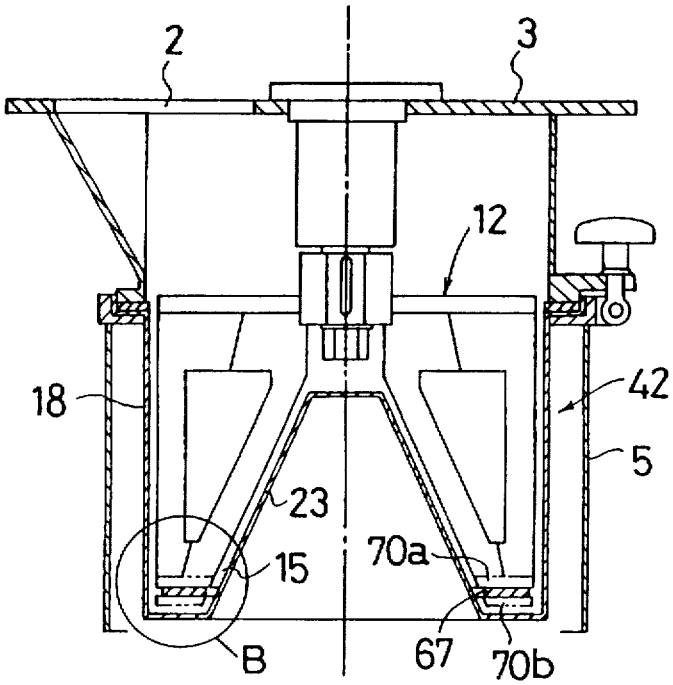
FIG. 17(A) is a sectional view schematically showing such a condition that the rotary blade of this embodiment is accommodated within the annular space of the double screen.
FIG. 17(B) is an enlarged view of the bottom portion of the annular space.
Figure 17:
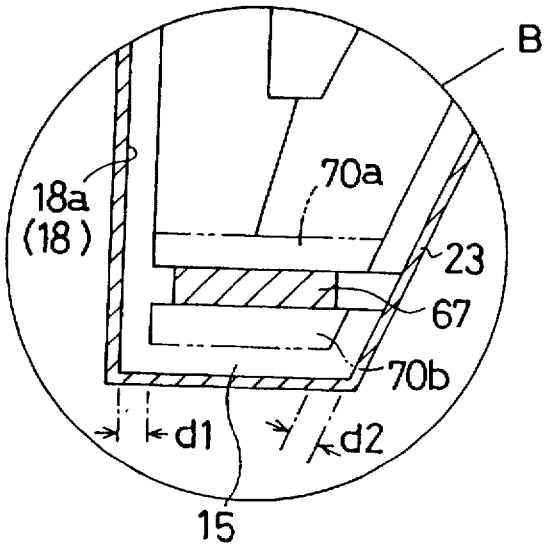

This rotary blade 12 is constructed by securing a ring 67 to the lower end of the rotary blade 12 shown in FIG. 9. The ring 67 has a ring external diameter defined smaller than an internal diameter of the cylindrical screen 18 so as to be accommodated within the lower area of the annular space 15 of the double screen 42 as shown in FIG. 17 and has a ring internal diameter defined larger than an external diameter of the lower portion of the conical screen 23. The ring 67 shown in FIG. 16 is formed by cutting a thin sheet steel like a ring and has a nearly rectangular cross section. A plurality of cutter vanes 70 are fixedly secured to the upper and the lower circumferential surfaces of the ring 67 so as to extend from a revolution center 68 of the ring 67 nearly in the directions of the radial lines 69.

Incidentally, though FIG. 16 shows the rotary blade 12 provided with two blades 16, the number of the blade 16 may be increased more than two depending on the diameter of the annular space screen. Also in the case of the one provided with at least two blades 16, an interval between the blades 16 in the circumferential direction can be set equal. There are provided the cutter vanes 70 so as to have equal intervals in the circumferential direction under the total number including the number of the arranged blades 16 and the number of the cutter vanes 70. For example, when explaining with reference to the construction shown in FIG. 16, while the two blades 16 are arranged in the opposed manner at a pitch angle of 180 degrees, there are provided three cutter vanes 70 within each angle range of 180 degree between the blades 16 respectively, namely there are provided six vanes 70 in the entire ring 67. Thereupon, the cutter vanes 70 are attached at a pitch angle of 45 degrees obtained by 360 degree/8 so as to have the eight equal intervals in total including the two blades 16. Incidentally, in the construction shown in FIG. 16, the cutter vanes 70 are secured to the ring 67 at an angle of $\alpha$ with respect to the radial line 69 extending from the revolution center 68. The direction of the angle $\alpha$ is set so that the outer peripheral leading end of the cutter vane 70 is lagged in the revolution direction of the rotary blade 12. The inclination angle a is preferably set to within a range of 5~45 degree in the counter-revolutional direction in consideration of the rubbing action for the granular material.

This angle $\alpha$ serves to accelerate the rubbing of the granular material against the cylindrical surface 18*a* of the cylindrical screen 18 by the cutter vanes 70 and the passing thereof through the cylindrical screen 18. This action is the same as that of the rotary blade 12 bent like "<" as shown in FIG. 12. In this embodiment, since there are provided the larger number of cutter vanes 70 having the same function and effect as those of the blades 16 of the rotary blade 12 than the number of the blades 16 in the bottom portion of the double screen 42, lumps in the granular material tending to gather into the screen bottom portion can be ground more effectively in the area adjacent to this bottom portion. This effect becomes more remarkable in the construction of the present invention in which the diameter of the rotary blade 12 is large also in the screen bottom portion so that the high circumferential speed can be obtained there.

Incidentally, though it is preferable to arrange also the cutter vanes 70 in the upper and the lower surfaces of the ring 67, even when they are arranged only in the lower surface thereof, a desired effect can be obtained. Though the ring 67 in FIG. 16 has the rectangular cross section formed by cutting the sheet steel, it can be manufactured by bending a round bar or a bar having another cross section.

FIG. 17(A) is a view showing schematically such a condition that the ring 67 and the cutter vanes 70 of the rotary blade 12 are accommodated within the lower portion of the double screen 42. Incidentally, when it is assumed that the cutter vanes 70 are arranged at the positions of the blades 16, their postures relative to the screen 42 are indicated by the imaginary line in FIG. 17(A). Configurations of an upper cutter vane 70*a* and a lower cutter vane 70*b* are defined so that the outside leading end of the cutter vane 70 is positioned to have a gap d1 with respect to the cylindrical surface 18*a* of the cylindrical screen 18 and the inside leading end thereof is positioned to have a gap d2 with respect to the inner surface of the conical screen 23 as shown in FIG. 17(B).

When rotating the rotary blade 12 of the present invention, usually the granular material passes through the screens 18, 23 outward under the normal grinding and uniformizing actions. If there are large stiff lumps in the granular material, they can't pass through the screens 18, 23 to eventually stagnate in the lower space. In this embodiment, however, the lumps in the granular material can be ground and uniformized effectively by the cutter vanes 70 secured to the ring 67. This third embodiment is especially suitable to such a case that the granular material is in the dry and stiff state. In this case, it is more effective for grinding the lumps to rotate the rotary blade 12 at a little higher speed.

<Fourth Embodiment>

Figure 18:
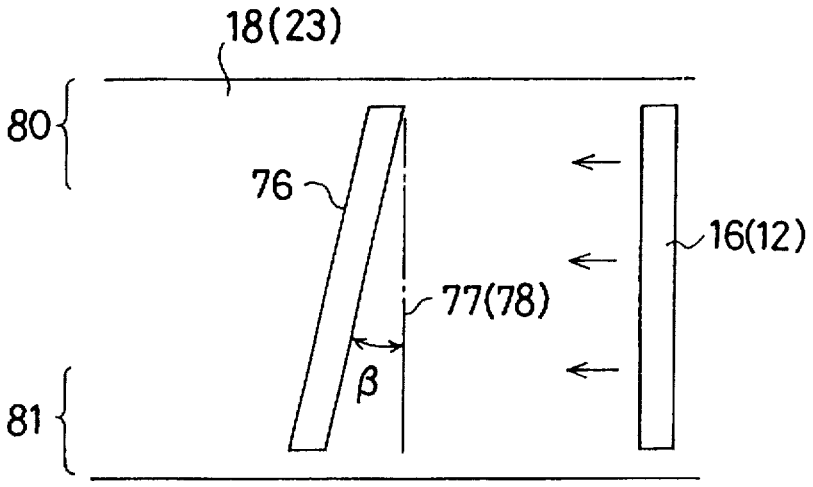
FIG. 18 is an explanatory view of a screen with a band plate showing a fourth embodiment of the present invention.
Figure 19:
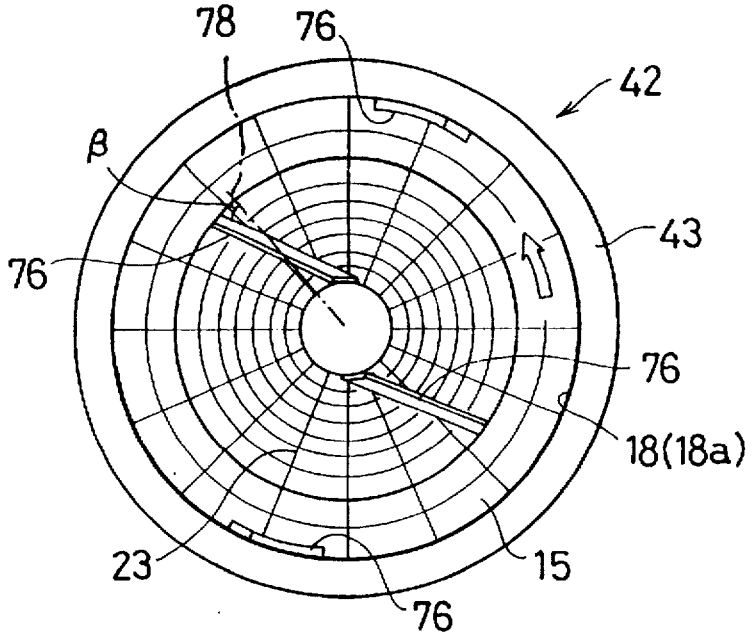
FIG. 19 is a plan view of the double screen with the band plates.
Figure 20:
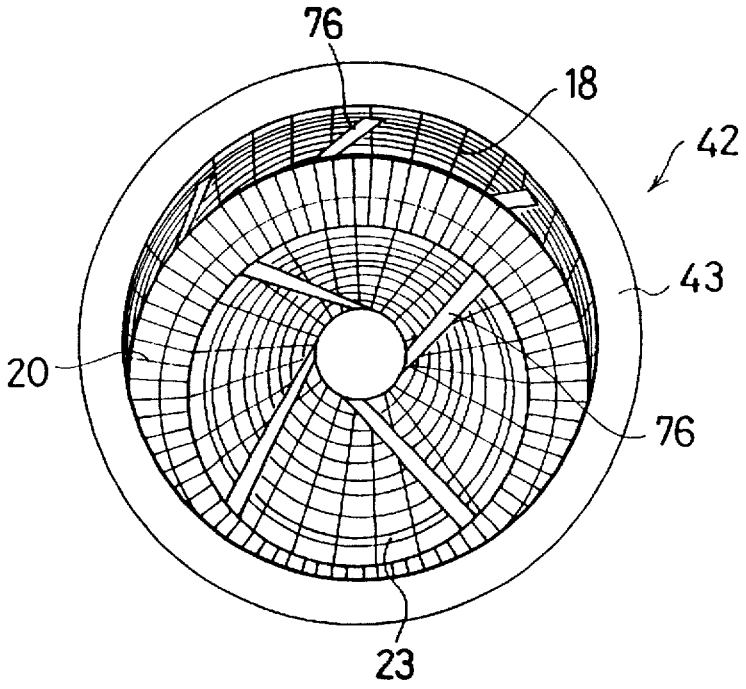
FIG. 20 is a perspective view of the double screen with the band plates.
Figure 21:
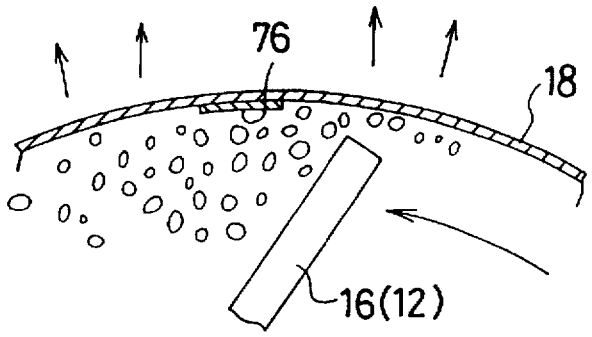
FIG. 21 is a schematic view for explaining a function of the band plate.

FIG. 18 is an explanatory view of a screen with a band plate showing a fourth embodiment of the present invention;

FIG. 19 is a schematic plan view of the double screen with the band plates; FIG. 20 is a perspective view of the double screen with the band plates; and FIG. 21 is a view for explaining a function of the band plate.

A feature of this fourth embodiment is that at least one band plate is fixedly secured to the screen surface opposed to the rotary blade within the annular space of the annular space screen, nearly along a generatrix line of the screen. Incidentally, the fourth embodiment has the feature that the band plate is attached to the screen surface, and the constructions explained in the first and the second embodiments (for example, the constructions shown in FIGS. 4 and 13 and so on) can be employed optionally as the other grinding and uniformizing apparatus and entire screen construction thereof.

As shown in FIGS. 18 and 19, the band plates 76 are secured to the screen surfaces 18, 23 nearly along the generatrix lines 77, 78. For example, the band plates 76 having a thickness of about 1 mm and a lateral width of about 12 mm extend along the generatrix line 77 of the inside cylindrical surface 18*a* of the cylindrical screen 18 and along the generatrix line 78 of the conical surface of the conical screen 23, and they are arranged in the respective circumferential surfaces in plural at an equal interval. Incidentally, in FIG. 18, the symbol 80 designates a screen upper portion, and the symbol 81 does a screen lower portion.

Especially, FIGS. 18~20 show examples in which the band plates are inclined at an angle of βrelative to the generatrix lines 77, 78. When the blades 16 extending along the generatrix lines pass over the band plates 76 under the twisted condition of the band plate 76 at the angle β, the passing point shifts from one end to the other end with a time lag, so that a passing shock can be dispersed and reduced in comparison with the case of the angle β being zero.

It is preferable for preventing the floating-up of the granular material that the direction of the angle β is set so that the passing point shifts downward (refer to FIG. 18) following the rotation of the blades 16. Incidentally, the angle β is preferably set to lower than 30 degrees in consideration of the accurate and easy manufacturing of spirally configurated one. The number of the band plate 76 to be arranged is two for the cylindrical screen 18 and for the conical screen 23 respectively in FIG. 19, and four for the conical screen 23 and seven to nine for the cylindrical screen 18 in FIG. 20.

As shown in FIG. 21, when the rotary blade 12 is rotated within the annular space 15, the gap between the rotary blade 12 and the screen 18 becomes narrower at the location of the band plate 76 to restrain the slipping of the granular material in the circumferential direction. Accordingly, when the granular material passes through the screen 18 slipping a short distance along the screen surface when being expelled by the rotary blade 12 during the grinding and uniformizing process, it is possible to increase an amount of the granular material passing through the screen 18 by preventing the excessive slipping of the granular material in the circumferential direction.

The present invention is not limited to the above-mentioned embodiments and may be applied with various design modifications without departing from the spirit and scope of the invention. Such modified embodiments will be explained hereinafter. Incidentally, the scope of the invention is presented by the scope of claims, but not limited by the description of the specification.

(1) The conical symmetrical body 14 of revolution is exemplified in the above-mentioned embodiments. But, various kinds of symmetrical bodies of revolution may be exemplified as a construction of the symmetrical body 14 of revolution of which diameter increases from its upper portion to its lower portion. As one example of such symmetrical bodies 14 of revolution can be mentioned a symmetrical configuration of revolution formed by a plurality of straight lines, single or a plurality of curved lines as shown in FIGS. 13(A)~(D). Similarly, also the outside screen 7 may be such a screen as having a symmetrical configuration of revolution formed by single or a plurality of straight lines and single or a plurality of curved lines corresponding to the construction of the symmetrical body 14 of revolution. Incidentally, when at least one of the symmetrical body 14 of revolution and the outside screen is constructed by using the curved surface as shown in FIGS. 13(C), (D), a manufacturing cost of the grinding and uniformizing apparatus increases by a cost for manufacturing the screen having the curved configuration.

Figure 14:
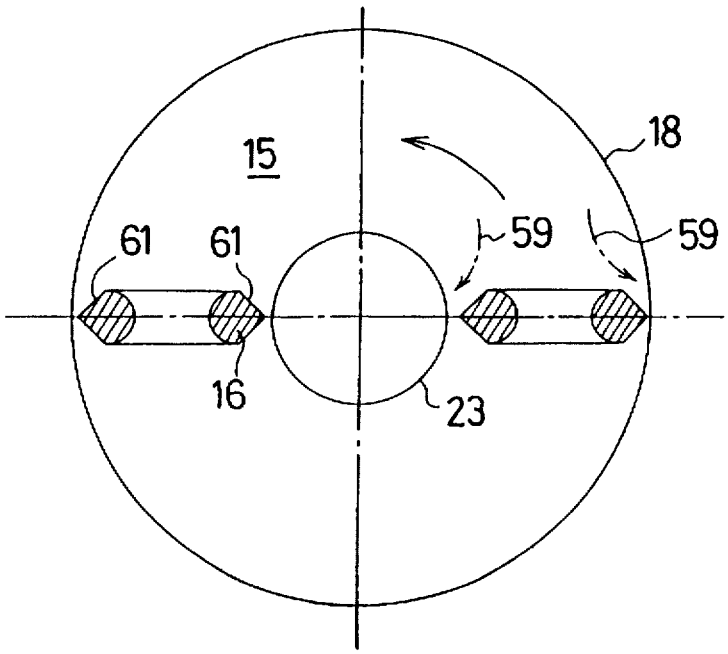
FIG. 14 is a schematic horizontal sectional view for explaining other embodiments of the rotary blade.
Figure 15:
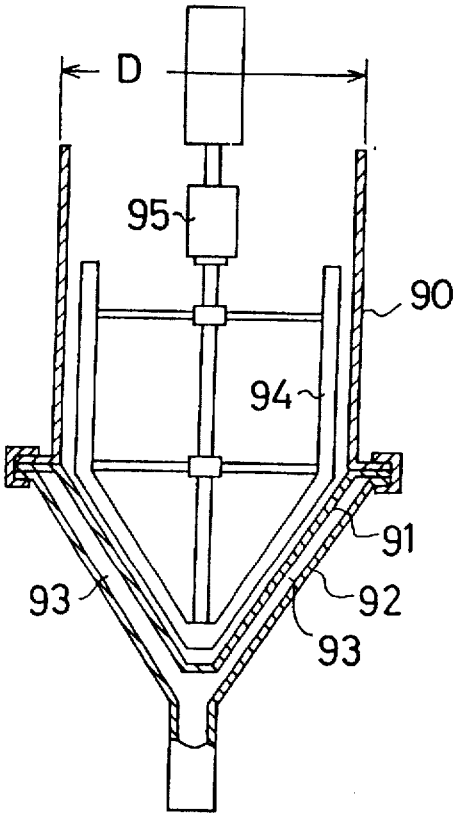
PRIOR ART FIG. 15
FIG. 15 is a vertical sectional view showing a schematic construction of a conventional apparatus for grinding and uniformizing grains.

(2) The rotary blade 12 in the above-mentioned embodiments may have not only the construction shown in FIG. 12, but also employ the blade 12 having sharp portions 61 formed at its outer edge portions so as to keep a suitable rubbing angle a as shown in FIG. 14. Since the grinding and uniformizing apparatus of the present invention serves to push the granular material onto the outer circumferential surface of the outside screen by the centrifugal force, practically the enough grinding and uniformizing effects can be attained even when the rubbing angle α and the like are not set strictly.

(3) When the granular product pushed out through the uniformizing openings 13 of the outside screen 7 and/or the inside screen 24 falls into continuous states, a cutter rotating together with the rotary blade 12 may be arranged on the outside of the outside screen 7 or on the inside of the inside screen 24 to cut the continuous product pushed out through the uniformizing openings.

(4) Though only one annular space is arranged in the annular space screen in the above-mentioned embodiment, it is obvious that also the grinding and uniformizing apparatus and the annular space screen having a plurality of annular spaces arranged concentrically about the revolution shaft are within the scope of the present invention.

(5) Though the number of the blades 16 of the rotary blade 12 is set to two for explanation in the first and the second embodiments, a large-scale grinding and uniformizing apparatus may have not only the diameter of the rotary blade 12 enlarged, but also the number of the blades 16 set to at least two by making use of the increased circumferential length of the blade to improve the processing capacity for the granular material. Incidentally, it is conventionally known in the field of the grinding and uniformizing apparatus that the number of the blades 16 is increased following the increasing of the diameter of the apparatus.

What is claimed is:

1. An apparatus for grinding and uniformizing grains comprising:

a casing provided with a supply opening for granular material and opened downward;

an outside screen attached to a lower position of the casing, the outside screen having its upper portion opened toward the casing, having a large number of uniformizing openings formed in its outer circumferential surface and being rotationally symmetrical with respect to a revolution shaft;

a symmetrical body of revolution provided with a large number of uniformizing openings, the symmetrical body positioned coaxially with the outside screen and disposed inside of the outside screen, the diameter of said symmetrical body increasing from its upper portion to its lower portion, the symmetrical body of revolution being connected to the outside screen at the respective lower portions thereof into an integral structure to form a screen with an annular working space having an annular space therein, and a rotary blade driven about the revolution shaft within an annular space formed between the outside screen and the symmetrical body of revolution with a predetermined gap kept relative to the outside screen and the symmetrical body of revolution.

2. An apparatus for grinding and uniformizing grains as set forth in claim 1, wherein the symmetrical body of revolution has an annular surface to be connected to a lower portion of the outer circumferential surface of the outside screen.

3. An apparatus for grinding and uniformizing grains as set forth in claim 2, wherein a large number of uniformizing openings are formed also in the annular surface of the symmetrical body of revolution.

4. An apparatus for grinding and uniformizing grains as set forth in claim 1, wherein an inclination angle (θ) of an inclined surface of the symmetrical body of revolution relative to a vertical axis is set larger than an inclination angle (ϕ), (ψ) of the outer circumferential surface of the outside screen (7).

5. An apparatus for grinding and uniformizing grains as set forth in claim 1, wherein the outside screen is a cylindrical screen.

6. An apparatus for grinding and uniformizing grains as set forth in claim 1, wherein the symmetrical body of revolution has a conical circumferential surface of which diameter becomes larger from its upper portion to its lower portion.

7. An apparatus for grinding and uniformizing grains as set forth in claim 1, wherein the outside screen is an inverted conical screen of which diameter becomes smaller from its upper portion to its lower portion.

8. An apparatus for grinding and uniformizing grains as set forth in claim 1, wherein the rotary blade has such a cross section as to bend at its middle and an opening formed at the middle of a blade with outer edge portions of the rotary blade remained like a frame.

9. An apparatus for grinding and uniformizing grains as set forth in claim 1, wherein the outside screen is a rotationally symmetrical screen formed by rotating a segment including at least one of a straight line and a curved line about the revolution shaft.

10. An apparatus for grinding and uniformizing grains as set forth in claim 1, wherein the symmetrical body of revolution is a symmetrical body of revolution formed by rotating a segment including at least one of a straight line and a curved line about the revolution shaft.

11. An apparatus for grinding and uniformizing grains as set forth in claim 1, wherein a ring to be accommodated in a lower area of the annular space is fixedly secured to a lower portion of the rotary blade, at least one cutter vane is fixedly secured to the ring, and the at least one cutter vane is slanted within a range of 5~45 degrees in a revolution lagged direction with respect to a radial line passing through a revolution center of the ring.

12. An apparatus for grinding and uniformizing grains as set forth in claim 1, wherein at least one piece of band plate extending nearly in the direction of a generatrix line of each screen is fixedly secured to the surface of the screen opposed to the rotary blade.

13. An apparatus for grinding and uniformizing grains comprising:

a casing having a revolution shaft inserted into an upper portion of said casino and a supply opening for granular material formed at said upper portion;

a double screen including a cylindrical screen attached to a lower portion of the casing, opened toward the casing at an upper portion of the cylindrical screen, the cylindrical screen provided with a large number of uniformizing openings, and a conical screen arranged coaxially with the cylindrical screen, the diameter of the conical screen increasing from an upper portion to a lower portion thereof and provided with a large number of uniformizing openings, the double screen being integrally formed by connecting the cylindrical screen to the conical screen at the respective lower portions thereof; and a rotary blade attached to a revolution shaft so as to be able to rotate keeping predetermined distances relative to the cylindrical screen and the conical screen respectively within an annular space having a nearly V-shaped section defined between the cylindrical screen and the conical screen.

14. An apparatus for grinding and uniformizing grains as set forth in claim 13, wherein the double screen is attached to a lower portion of the casing (3) at the upper opening of the cylindrical screen.

15. An apparatus for grinding and uniformizing grains as set forth in claim 13, wherein the double screen has an annular surface for connecting the cylindrical screen to the conical screen, the annular surface being formed as an annular screen provided with a large number of uniformizing openings.

16. An apparatus for grinding and uniformizing grains as set forth in claim 15, wherein the cylindrical screen and the conical screen are detachable to each other at a connection portion of the annular screen.

17. An apparatus for grinding and uniformizing grains as set forth in claim 13, wherein the rotary blade is attached to the revolution shaft through an adjustment metal piece of which thickness can be set changeably, so as to be adjusted relative to the revolution shaft.

18. An apparatus for grinding and uniformizing grains as set forth in claim 13, wherein the double screen is attached to the casing through an adjustment washer of which thickness can be set changeably, so as to be adjusted relative to the casing.

* * * * *